United States Patent [19]

Perrot

[11] 4,213,295

[45] Jul. 22, 1980

[54] ARRANGEMENT FOR SECURING A DIAL TO A PLATE IN A TIMEPIECE

[75] Inventor: Friedrich Perrot, Lengnau, Switzerland

[73] Assignee: ETA A.G. Ebauches-Fabrik, Solothurn, Switzerland

[21] Appl. No.: 892,751

[22] Filed: Apr. 3, 1978

Related U.S. Application Data

[63] Continuation-in-part of Ser. No. 716,349, Aug. 20, 1976, abandoned.

[30] Foreign Application Priority Data

Sep. 12, 1975 [CH] Switzerland ..... 11855/75

[51] Int. Cl.[2] ..... G04B 19/06

[52] U.S. Cl. ..... 368/236

[58] Field of Search ..... 58/126 R, 126 A, 127 R, 58/127 B, 127.5, 104; 29/231, 235; 403/323, 350, 355, DIG. 8

[56] References Cited

U.S. PATENT DOCUMENTS

| | | | |
|---|---|---|---|
| 1,400,421 | 12/1921 | Colomb | 58/127 B |
| 1,911,308 | 5/1933 | Colomb | 58/127 B |
| 3,523,417 | 8/1970 | Morita | 58/127 B |

FOREIGN PATENT DOCUMENTS

| | | | |
|---|---|---|---|
| 451172 | 9/1927 | Fed. Rep. of Germany | 58/127 B |
| 77267 | 11/1917 | Switzerland | 58/127 B |
| 87219 | 2/1920 | Switzerland | 58/127 B |
| 185463 | 7/1936 | Switzerland | 58/127 B |
| 334381 | 11/1958 | Switzerland | 58/127 B |
| 353310 | 5/1961 | Switzerland | 58/127 B |

*Primary Examiner*—Vit W. Miska

*Attorney, Agent, or Firm*—Stevens, Davis, Miller & Mosher

[57] ABSTRACT

An arrangement for securing a timepiece dial having feet to a plate having bores for receiving the feet comprises attachment means each having a shank with a head, each shank being inserted in an additional bore in the plate substantially parallel to a bore receiving a foot. The head includes a collar, taking the form of a cutting edge, which partially surrounds the head and shank concentrically. The shank includes a cylindrical portion fitted to the diameter of the additional bore and another cylindrical portion of smaller diameter so that the shank may be more easily inserted in that bore.

1 Claim, 7 Drawing Figures

ARRANGEMENT FOR SECURING A DIAL TO A PLATE IN A TIMEPIECE

Figure 1:
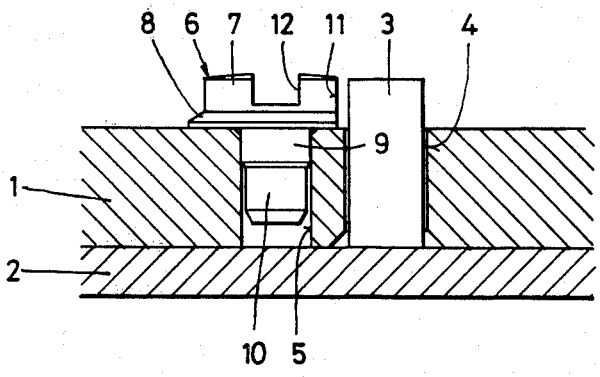

This is a continuation-in-part of Ser. No. 716,349, filed Aug. 20, 1976 now abandoned.

This invention relates to an arrangement for securing a dial to a plate in a timepiece.

Such arrangements are known in which the attachment means each comprise a head and a threaded shank, the head being partially surrounded by a collar acting as a cutting edge. When this known attachment means is in its operative position, the cutting edge partially penetrates into an associated dial foot and thus holds the foot fast. Although this arrangement holds the dial very satisfactorily, it is not only expensive, but the insertion of the attachment means into the plate and the securing of the dial can be carried out automatically only by using very complicated devices, if at all.

One reason why the aforementioned securing arrangement is expensive is that threads must be cut on the attachment means and in the plate. During assembly, the attachment means must first be screwed into the thread in the plate almost all the way, until the head rests upon the plate. Because the location of the recess in the cutting collar is not defined with respect to the beginning of the threads in the plate and on the shank, this recess is very seldom in the correct position after the attachment means has been screwed into the plate. Therefore, a further operation is required to align the head with the bore in the plate into which the dial foot is to be inserted. After the dial has been set in place, the attachment means is screwed back in the opposite direction, and the cutting edge partially penetrates into the foot projecting above the plate, the foot being carried along by the outward movement of the attachment means so that the dial is pulled tight against the plate. It will be obvious that these operations require considerable skill and sensitivity on the part of the persons who carry out this delicate work. Hence this type of assembly is quite costly.

It is an object of this invention to provide a dial-securing arrangement utilizing attachment means which are simpler, hence less expensive to manufacture, and enable a simpler type of assembly which can easily be carried out automatically.

According to the present invention there is provided an arrangement for securing a dial to a plate in a timepiece, the plate comprising two or more first bores and a like number of second bores, and the dial comprising two or more feet respectively extending into the first bores, rotatable attachment means being respectively associated with each of the dial feet and with each of the second bores, each attachment means comprising a head resting against the plate and including a collar concentric with the axis of rotation of the attachment means, partially surrounding the head and taking the form of a cutting edge, and a shank extending into the associated second bore and including a first cylindrical portion and a second cylindrical portion smaller in diameter than the first cylindrical portion.

Figure 2:
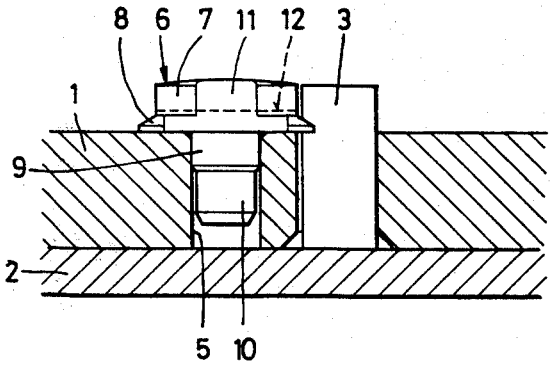
Figure 3:
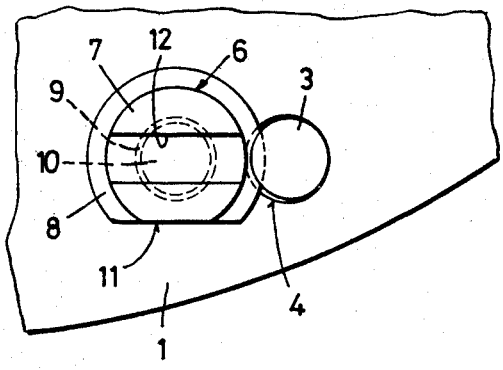
Figure 4:
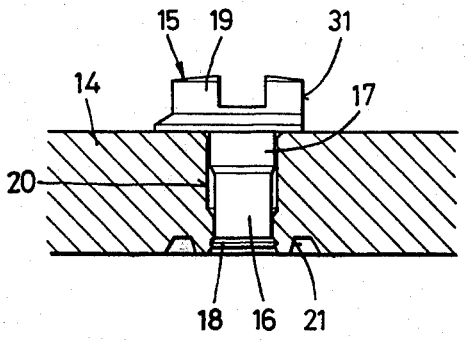
Figure 5:
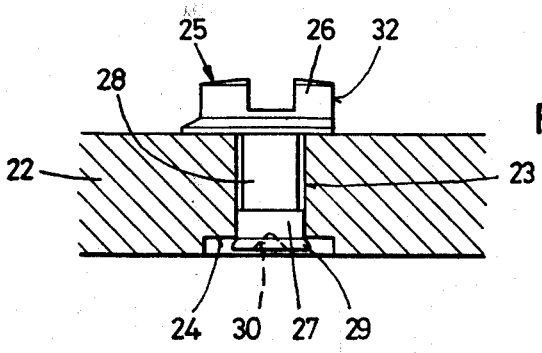
Figure 6:
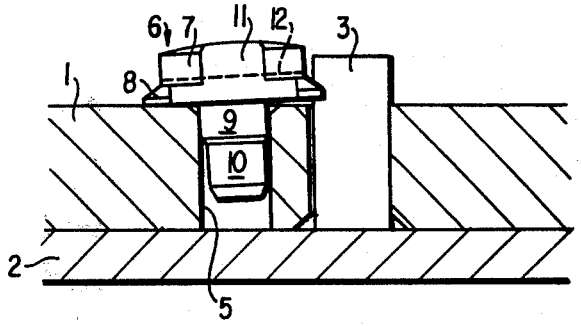
Figure 7:
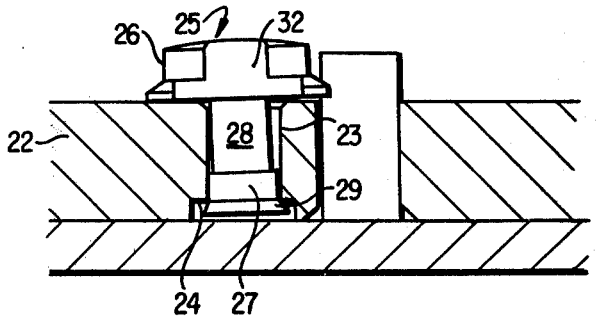

Preferred embodiments of the invention will now be described in detail with reference to the accompanying drawings, in which:

FIG. 1 is an elevation of the securing arrangement, the dial and the plate being shown only partially in cross-section, FIG. 2 is an elevation similar to FIG. 1, showing the securing arrangement in its operative position, FIG. 3 is a top plan view of the securing arrangement illustrated in FIG. 2, FIG. 4 is an elevation of part of a second embodiment of the securing arrangement, FIG. 5 is an elevation of part of a third embodiment of the securing arrangement, FIG. 6 is an elevation similar to FIGS. 1 and 2, showing, in exaggerated form, how the attachment means causes the dial to lie tightly against the plate, and FIG. 7 is an elevation similar to FIG. 5 showing, in exaggerated form, how the attachment means causes the dial to lie tightly against the plate.

In FIGS. 1 and 2, illustrating a first embodiment of the securing arrangement according to the present invention, a plate 1 and a dial 2 of a timepiece are shown only partially in cross-section. A foot 3 secured to the dial 2 extends through a bore 4 in the plate 1. Inserted into a second bore 5, the longitudinal axis of which is substantially parallel to that of the bore 4, is an attachment means 6. Although there are actually two feet 3 secured to the dial 2, only one foot 3 is shown in each of the figures for the sake of simplicity.

The attachment means 6 has a head 7, partially surrounded by a collar 8 which is concentric with the axis of rotation of the attachment means 6, a cylindrical portion 9, and a cylindrical portion 10 which is smaller in diameter than the portion 9. The continuous cylindrical outer surface of portion 9 acts as a guiding surface and rests against the inside wall of the bore 5 because the shank of the attachment means 6 has been snugly fitted into the bore 5. This snug fit is advantageous because the attachment means 6 is thereby prevented from falling out of the bore 5 unintentionally and cannot rotate about its axis without external force being applied. Portions of the head 7 and the collar 8 have been cut off along a sectional plane, preferably parallel to the axis of rotation of the attachment means 6, thus producing a cut surface 11. The head 7 further comprises a slot 12 for receiving the tip of a screwdriver-like tool (not shown). The slot 12 is preferably made in the same operation as the cut surface 11 and consequently runs parallel thereto.

The distance between the longitudinal axes of the bores 4 and 5 in the plate 1 is such that in the operative position of the attachment means 6, the collar 8 projects partially over the edge of the bore 4. The distance between the cut surface 11 and the axis of rotation of the attachment means 6 is such that when the attachment means 6 is in the position illustrated in FIG. 1, the opening of the bore 4 is unobstructed, and the dial foot 3 may be inserted in the bore 4 without hindrance. After the foot 3 has been inserted, the attachment means 6 is turned through an angle of about 90° by the above-mentioned tool and assumes the position shown in FIGS. 2 and 3. This rotation of the attachment means 6 causes the collar 8, acting as a cutting edge, to penetrate partially into the foot 3, thus holding the foot 3, and consequently the dial 2, fast.

While the attachment means 6 is being turned, the foot 3 is pushed to the right, as viewed in FIG. 2, and an opening force acts radially upon the collar 8. This produces a clamping effect which holds the attachment means 6 tightly in the bore 5. This clamping effect is characteristic of all the embodiments of the claimed invention. The length of the earlier-mentioned snug fit is dependent upon the length of the cylindrical portion 9 along its longitudinal axis. The shorter this length, the less problematic are the effects of manufacturing tolerances upon the action of the snug fit.

The cylindrical portion 9 may also be smaller in diameter than the bore 5. In this case, the attachment means 6 is not inserted in the bore 5 until after the dial foot 3 has been inserted in the bore 4, in the position in which the foot 3 is shown in FIG. 1, whereupon the attachment means 6 is immediately turned through an angle of about 90° with the aforementioned tool. The attachment means 6 is moved away from the foot 3 by the opposing force thus produced, so that the cylindrical portion 9 rests against the inside wall of the bore 5 only partially, and a clamping effect is produced which causes the attachment means 6 to fit tightly enough in the bore 5.

The use of the attachment means 6 described above greatly simplifies the operations for securing the dial 2, so that these operations can quite easily be carried out automatically, and assembly is made considerably more efficient. Moreover, since no threads need be cut either on the attachment means 6 or in the plate 1, manufacturing costs are further reduced.

The snug fit with which the cylindrical portion 9 of the attachment means 6 is inserted into the bore 5 keeps the attachment means 6 from falling out of the bore 5 unintentionally and ensures that it stays in the position shown in FIG. 1 for inserting the foot 3 in the bore 4. The diameter of the foot 3 is preferably about 10% less than that of the bore 4. This facilitates both insertion of the foot 3 into the bore 4 and removal of the dial 2 in the event that the timepiece needs to be overhauled or repaired, even when the material near the foot 3 has been displaced by the collar 8.

FIG. 4 shows part of a plate 14 in cross-section and a second embodiment of an attachment means 15. The latter differs from the attachment means 6 of FIGS. 1 and 2 only in that a portion 16 of the shank, smaller in diameter than a cylindrical portion 17, is longer than the corresponding portion 10 of the shank illustrated in FIGS. 1 and 2, and in that the free end of the portion 16 is surrounded by a rib 18 projecting radially outwards. On the side of the plate 14 remote from a head 19 of the attachment means 15, the material adjacent to the mouth of an originally smooth bore 20 has been pressed about the rib 18 by impressing an annular groove 21 surrounding the bore 20, using a tool (not shown) having an annular head.

FIG. 5 shows in cross-section part of a plate 22 having a bore 23 and a recess 24. Inserted into the bore 23 is the shank of an attachment means 25, the head 26 of which is shaped similarly to the heads 7 and 19 of the attachment means 6 and 15, illustrated in FIGS. 1 and 4, respectively. A cylindrical portion 27 of the shank of the attachment means 25, which portion 27 rests against the inside wall of the bore 23, is disposed at the free end of the shank, while a shank portion 28 having a smaller diameter is situated between the portion 27 and the head 26. At the end of the portion 27 which extends into the recess 24 there is a bead 29 projecting radially outwards which prevents the attachment means 25 from coming out of the bore 23. The bead 29 is preferably formed by pressing a conical depression 30 into the end face of the portion 27, using a punch-like tool (not shown); the edge material of the portion 27 then forms the bead 29, simultaneously preventing the attachment means 25 from being able to rotate by itself.

In the embodiment according to FIG. 5, an advantageous tractional effect is produced upon the dial foot (not shown in FIG. 5). When the attachment means 25 is turned into its operative position, the portion 28 of the shank is moved away from the dial foot, whereby that part of the collar which has penetrated into the foot is biased upwards, as illustrated in exaggerated form in FIG. 7. As a result, traction is exerted upon the foot, so that the dial rests tightly against the plate 22. This tractional effect is characteristic of all the embodiments of the claimed invention.

The two embodiments of the attachment means 15 and 25 illustrated in FIGS. 4 and 5 are intended for timepiece movements in which these attachment means are the first elements fitted on the plates 14 and 22, respectively. In fitting the attachment means, care will naturally be taken to ensure that respective cut surfaces 31 and 32 are positioned substantially perpendicular to a straight line connecting the longitudinal axes of the bores 20 and 23 with those of the respective bores (not shown in FIGS. 4 and 5) intended to receive the dial feet.

The attachment means described above for securing the dial can be inserted in the associated bore in the plate by means of a purely axial movement. Only a rotary movement of about 90° is necessary to secure the dial feet. Owing to the concentric design of the collar, the angle through which the attachment means must be turned can be predetermined. These simple motional operations may be easily automated, thus substantially reducing the time required for assembly. The production of the attachment means according to the present invention is much simpler than that of the prior art designs having an eccentric or helical collar, or a collar of continuously increasing circumferential thickness.

In the attachment means according to the present invention, the stepped portion of the shank results in a certain springiness which contributes toward biasing the dial foot, thus causing the dial to lie tightly against the plate. As described earlier, the shank includes a first cylindrical portion and a second cylindrical portion smaller in diameter than the first cylindrical portion. The special design of the shank of the attachment means, i.e., the subdivision of the shank into two cylindrical portions of different diameters, enables a deviation of the attachment means about an axis perpendicular to its own longitudinal axis. Since the cylindrical portion having the greater diameter has a diameter approximately the same as the diameter of the bore in which the shank is introduced, and is of limited axial length, the attachment means will exhibit such deviation when the cutting edge of the head of the attachment means penetrates the dial foot. The direction of such deviation is such that the portion of the head of the attachment means nearest the dial foot is biased from the plate, while the remaining portion of the head of the attachment means remains in contact with the plate. At the same time, the dial foot is pushed toward that portion of its bore distant from the bore associated with the attachment means. The deviation of the attachment means is facilitated by the material of the plate, which is normally softer than the material of which the attachment means is made. The movement of the attachment means and the dial foot is a natural consequence of the operation of the claimed invention; opposing forces generating such movement are always produced once the cutting edge of the head of the attachment means contacts and partially penetrates the dial foot. Because of the configuration of the attachment means, these opposing forces must result in a tractional action so that the dial rests intensively against the lower side of the plate and a clamping action so that the attachment means is held tightly in its associated bore. The reaction of the attachment means and the dial foot to the opposing forces is illustrated in exaggerated form in FIGS. 6 and 7 for the embodiments of FIGS. 2 and 5 respectively.

What I claim is:

1. An arrangement for securing a dial to a plate in a timepiece, said plate comprising a first bore and a second bore, and said dial comprising a foot extending through said first bore, rotatable attachment means being associated with said foot and with said second bore, said attachment means comprising a head resting against said plate and including a collar concentric with the axis of rotation of said attachment means, surrounding said head and taking the form of a cutting edge, which except for a chordwise flat portion is of a diameter to form an interference fit with said foot, said collar being of constant thickness at any given radial distance, and a shank extending into said second bore and including a first cylindrical portion and a second cylindrical portion smaller in diameter than said first cylindrical portion, wherein said second cylindrical portion is disposed between said head and said first cylindrical portion, said shank further comprising at the end thereof remote from said head a radially projecting bead larger in diameter than said first cylindrical portion, and said plate further comprising a recess for receiving said bead, whereby said attachment means is prevented from being dislodged from said associated second bore.

* * * * *